United States Patent [19]

La See

[11] Patent Number: 4,854,100

[45] Date of Patent: Aug. 8, 1989

[54] CONCEALED SNAP-IN GRILL CLIP

[76] Inventor: Jack C. La See, 308 West Cedar, Abbotsford, Wis. 54405

[21] Appl. No.: 239,944

[22] Filed: Sep. 2, 1988

[51] Int. Cl.[4] ..... E06B 3/68

[52] U.S. Cl. ..... 52/456; 52/507; 52/717.1; 49/57; 49/62

[58] Field of Search ..... 52/311, 314, 507, 455, 52/456, 717, 656; 49/57, 62; 411/477, 484

[56] References Cited

U.S. PATENT DOCUMENTS

| | | | |
|---|---|---|---|
| 2,681,481 | 6/1954 | Mason | 49/62 |
| 3,099,865 | 8/1963 | Burnett | 49/57 |
| 3,372,522 | 3/1968 | Engstrom | 52/507 |
| 3,708,939 | 1/1973 | Herr | 52/311 |
| 4,586,306 | 5/1986 | Webb | 52/311 |
| 4,644,721 | 2/1987 | Bloomquist et al. | 52/456 |
| 4,665,663 | 5/1987 | Governale | 52/456 |

*Primary Examiner*—Michael Safavi

*Attorney, Agent, or Firm*—Herman H. Bains

[57] ABSTRACT

A plurality of concealed attachment clips are used for securing a grill to a window or door frame. The attachment clips are generally of L-shaped configuration, including a flat body portion having a pointed end, which is forcibly urged between the window or door frame and inner surface of the window or door pane. A coupling portion extends at substantially right angular relation from the body portion and includes a dome-shaped detente. The grill is comprised of grill bars, and each grill bar has a semi-spherical recess therein. The ends of the grill bars are forced over the detentes of the clips to releasably secure the grill to the window or door frame.

4 Claims, 1 Drawing Sheet

CONCEALED SNAP-IN GRILL CLIP

This invention relates to a novel clip for use in securing a conventional grill to a window or door frame.

BACKGROUND OF THE INVENTION

Many kinds of windows and doors are typically provided with grills to enhance the appearance thereof. These grills are usually removable, and various types of fasteners are used to attach the grills to the window or door frame. In order to avoid impairing the appearance of the grill, attempts have been made to develop concealed fasteners.

For example, U.S. Pat. No. 4,644,721 discloses a concealed type clip, which is used to secure a grill to a window or door frame. However, this particular arrangement requires the grill bar to be provided with specially designed slots to allow specially designed fastening clips to be cammed into the slots.

SUMMARY OF THE INVENTION

An object of this invention is to provide a novel concealed clip, of simple and inexpensive construction, for use in readily attaching a grill to a door or window frame.

Another object of this invention is the provision of concealed fastening clips for attaching a grill to a window or door frame, in which the clips are each provided with a dome-shaped detente for engaging in a semi-spherical recess in the ends of the grill bars.

In carrying out the invention, a plurality of substantially identical grill clips are provided for attaching each grill to a window or door frame. Each clip includes a flat body portion, which is inserted between the frame and the window or door glass pane. Each clip has a coupling portion, which extends at substantially right angles from the body portion. The coupling portion of each clip is provided with a dome-shaped detente, which engages in a dome-shaped recess in the end of a grill bar. With this arrangement, very little alteration is required with respect to the grill bars of the grill clip. The novel clips are not only concealed when the grill is attached to the window or door frame, but the clips are operable to permit ready attachment and removal of the grill with respect to the window or door frame.

FIGURES OF THE DRAWING

DESCRIPTION OF THE PREFERRED EMBODIMENT

Figure 1:
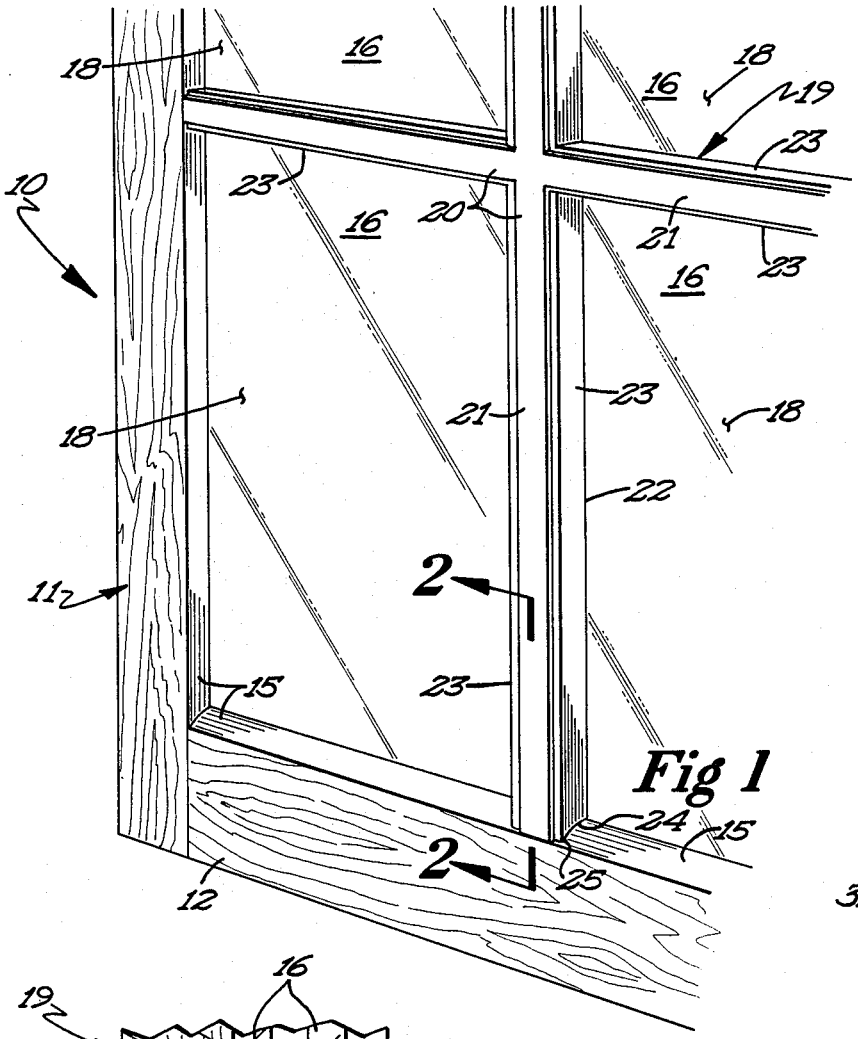
FIG. 1 is a perspective view of the novel grill clip incorporated in a window frame for securing a conventional grill thereto.

Referring now to the drawings and, more specifically, to FIG. 1, it is pointed out that the novel fastening clips are used to attach a conventional grill to a window 10. The window 10 is of conventional construction and includes a generally rectangular-shaped frame 11 comprised of frame members 12 secured to each other in substantially right angular relationship. The frame members 12 are recessed to define a flat surface 13 disposed at substantially right angles to a flat surface 14. Conventional flat substantially transparent spaced apart panes 16 engage the flat surface 13, and one of the panes is positioned against the flat surface 14 in a well-known manner. The frame members 12 of the frame 11 are also provided with a convex surface portion 15, which is located on the inner surface of the window 10.

A suitable glazing compound 17 sealingly secures the glass panes to the frame 11, and the glazing compound is applied to both the inner and outer surfaces of each of the panes 16, adjacent their peripheral edge portions thereof. It will be noted that the innermost pane 16 is provided with a substantially flat inner surface 18, which faces inwardly of the door or window.

The grill 19, which is attached to the window 10, is of conventional overall construction and is comprised of a plurality of interconnected horizontal and vertical grill bars 20. Each of the grill bars includes an outer surface 21, a substantially flat planar inner surface 22, and substantially parallel side surfaces 23. Each grill bar 20 also has concave end surfaces 24, which are contoured to mate with the convex surface portion 15 of each frame member 12, It will also be noted that each grill bar 20 has a longitudinally extending lip 25 that extends longitudinally from the grill bar. Each end of the grill bars is recessed, as at 26, to define flat surfaces **26*a* and 26*b*, disposed in right angular relation to each other. Finally, it will be seen that the end surface 26*b* of each grill bar is provided with a semi-spherical recess 26*c*** therein, the function of which will be discussed more fully hereinbelow.

Figure 3:
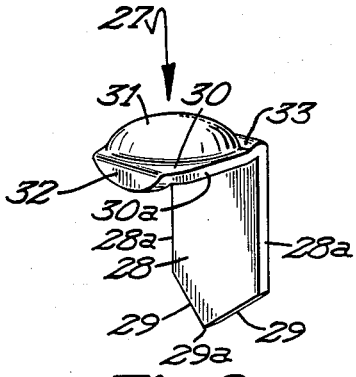
FIG. 3 is an exploded perspective view of a clip.
Figure 2:
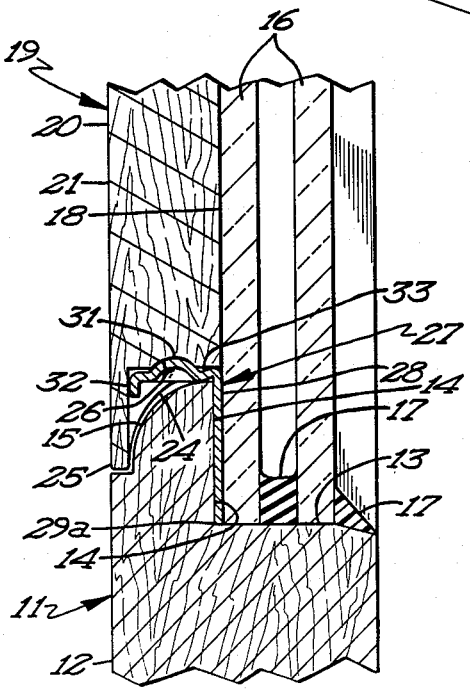
FIG. 2 is a cross-sectional view taken approximately along lines 2—2 of FIG. 1 and looking in the direction of the arrows.
Figure 4:
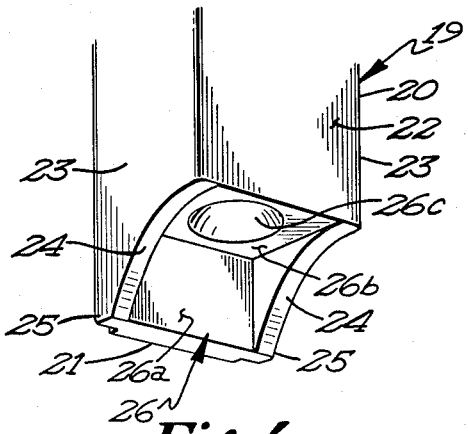
FIG. 4 is an end portion of a grill bar, illustrating the details of construction thereof.

The means for securing the grill 19 to the window 10 comprises a plurality of substantially identical single-pieced grill engaging clips 27, as best seen in FIG. 3. Each clip includes a generally rectangular-shaped flat body portion 28, having substantially straight parallel side edges **28*a* that terminate in converging edges 29 that define a pointed end 29*a*. Each clip also includes a substantially flat, generally rectangular-shaped coupling portion 30 that has opposed substantially straight parallel side edges 30*a*. The side edges 30*a* are coextensive with the straight edges 28*a* of the body portion 28. It will be noted that the coupling portion 30 extends at substantially right angles from the body portion 28**.

The coupling portion 30 of each clip is provided with a semi-spherical recess engaging element or detente 31 that extends therefrom. The detente 31 is shaped and sized to fit within the recess 26 in an end of a grill bar 20. The coupling portion 30 of each clip also has a lip 32 extending at substantially right angles from the outer end thereof, and which is disposed in substantially parallel relation with the flat body portion 28. The lip 32 imparts rigidity to the coupling portion and also provides a gripping surface during the formation of the detente 31 in a stamping operation. It will also be noted that the coupling portion 30 of each clip a step 33 which forms an acute angle is connected to the body portion by way of with respect to the body portion 28. It will be noted that step 33 is defined adjacent the inner end of the coupling portion and the body portion 28. The step is defined between an inner peripheral edge of the coupling portion and the adjacent peripheral edge portion of the recess engaging element 31. This permits a user to apply a screwdriver to the step when the clips are secured to a window.

In use, a plurality of the clips would be applied to the window 10 by forcibly urging the body portion of each clip between the inner surface of the window pane 16 and the flat surface 14. The pointed end 29a of the body portion permits the body portion to penetrate the glazing compound and the step 33 allows the user to use a screwdriver to force the clip in place. It will be noted that a pair of clips 27 will be applied to the window in opposed relation with respect to each other so that the two clips will engage opposite ends of a grill bar. The dome-shaped recess in one end of each grill bar will be positioned over the dome-shaped detente of one of the clips, and the other end of the grill bar will be urged towards the inner surface of the inner pane 16 until the recessed end of the bar snaps into place over the dome-shaped detente of the associated clip. With this arrangement, the grill may be readily applied to and removed from a window or door. It will be seen that the grill clips 27 are completely concealed from the inside so that the grill 20 will appear to be secured to the frame 11, while engaging the inner surface of the innermost pane 16.

From the foregoing description, it will be seen that the novel clips are not only concealed from the inside when used to attach a grill to a window, but the clips may be readily applied to the window without the use of any specialized tools. It will also be noted that the particular construction of the novel clips does not require extensive alteration or shaping of the grill bar, but merely requires the provision of a small ball-shaped recess.

Thus, it will be seen that my novel grill attaching clips are not only of simple and inexpensive construction, but function in a more efficient manner than any heretofore known comparable clip.

What is claimed is:

1. In combination with a window including a generally rectangular-shaped frame having a generally convex inner frame surface portion, a glass window pane mounted in the frame and having inner and outer surfaces, a grill comprised of a plurality of grill bars interconnected with each other in right angular relation, and each grill bar having an outer surface and an inner surface, said outer surface engaging the inner surface of the glass pane, each grill bar having concave end surfaces contoured to mate with the convex inner frame surface portion of the frame, each concave end surface of each grill bar having a semispherical recess therein spaced from the inner surface of the grill bar, a plurality of identical one-piece grill engaging clips, each clip including a substantially flat body portion having one end thereof pointed and being insertable between the frame and the glass pane, each clip including a flat coupling portion integral with and extending in substantially right angular relation from the other end of said body portion, a major portion of said coupling portion being shaped to define a semi-spherical coupling element projecting therefrom, the recesses at opposite ends of each grill bar engaging the coupling element of a pair of clip members with snap coupling effect to secure the grill to the frame and against the inner surface of the pane.

2. The invention as defined in claim 1 wherein a step is formed between the body portion and the coupling portion of each clip with an acute angle formed between the step and body portion to thereby define a step recess between the semi-spherical coupling element and step for accommodating a screw driver or the like for facilitating the insertion of the body portion.

3. The invention as defined in claim 1 wherein opposite end portions of each grill bar are relieved to define flat right angular surfaces thereat, said semi-spherical recess being formed in one of said flat surfaces at one end of each grill bar.

4. The invention as defined in claim 1 wherein each clip has a lip thereon integral with and extending at substantially right angle relation with the coupling portion and in substantially parallel relation with respect to said body portion.

* * * * *